US009662875B2

(12) United States Patent
van der Heijden et al.

(10) Patent No.: US 9,662,875 B2
(45) Date of Patent: May 30, 2017

(54) DEVICE FOR SUPPLYING FOIL TO A PRINTING PRESS AND METHOD FOR DETERMINING CHARACTERISTICS OF CONTROL OF SUCH A DEVICE

(71) Applicant: Vinnovation Holding B.V., Rosmalen (NL)

(72) Inventors: Vincent van der Heijden, 's-Hertogenbosch (NL); Arjan Neet, 's-Hertogenbosch (NL)

(73) Assignee: Vinnovation Holding B.V., Rosmalen (NL)

( * ) Notice: Subject to any disclaimer, the term of this patent is extended or adjusted under 35 U.S.C. 154(b) by 0 days.

(21) Appl. No.: 14/923,925

(22) Filed: Oct. 27, 2015

(65) Prior Publication Data

US 2017/0080703 A1 Mar. 23, 2017

(30) Foreign Application Priority Data

Sep. 18, 2015 (EP) ..... 15020165

(51) Int. Cl.

| | |
|---|---|
| ***B41F 1/34*** | (2006.01) |
| ***B41F 33/16*** | (2006.01) |
| ***B41F 19/00*** | (2006.01) |
| ***B41F 16/00*** | (2006.01) |
| ***B41F 13/06*** | (2006.01) |
| ***B41F 13/58*** | (2006.01) |
| ***B41F 19/06*** | (2006.01) |

(52) U.S. Cl.

CPC ..... *B41F 33/16* (2013.01); *B41F 13/06* (2013.01); *B41F 13/58* (2013.01); *B41F 16/006* (2013.01); *B41F 16/0013* (2013.01); *B41F 16/0033* (2013.01); *B41F 19/004* (2013.01); *B41F 19/005* (2013.01); *B41F 19/062* (2013.01); *B41P 2233/10* (2013.01)

(58) Field of Classification Search

CPC ..... B41F 19/005
USPC ..... 101/481
See application file for complete search history.

(56) References Cited

U.S. PATENT DOCUMENTS 6,202,549 B1 * 3/2001 Mitsam ..... B41F 19/062 9/62
6,334,248 B1 * 1/2002 Gallagher ..... B41F 19/062 156/233

(Continued)

FOREIGN PATENT DOCUMENTS

| | | | |
|---|---|---|---|
| EP | 1155831 | A2 | 11/2001 |
| EP | 2340936 | A1 | 7/2011 |
| WO | 94/13487 | A1 | 6/1994 |

OTHER PUBLICATIONS

Extended European Search Report for EP Application No. 15020165 dated Mar. 10, 2016.

*Primary Examiner* — Anthony Nguyen
(74) *Attorney, Agent, or Firm* — Troutman Sanders LLP; Ryan A. Schneider

(57) ABSTRACT

A device including a computing unit that is adapted to read a pattern of transfer portions to be realized by means of a printing process prior to operation of the device and to evaluate various options as to input of at least one foil web to the device and reuse of a length of foil web in the device so as to determine that option involves the most efficient use of the foil for realizing the pattern, so that output is obtained that is suitable to be used for realizing optimal control of the device.

14 Claims, 5 Drawing Sheets

(56) References Cited

U.S. PATENT DOCUMENTS

| | | | | |
|---|---|---|---|---|
| 8,967,221 | B2 * | 3/2015 | Eitel | B32B 37/22 156/510 |
| 9,162,438 | B2 * | 10/2015 | Drinic | B41F 19/062 |
| 9,358,776 | B2 * | 6/2016 | King | B32B 37/1284 |
| 2008/0295710 | A1 * | 12/2008 | Ohsawa | B41F 7/06 101/23 |
| 2010/0212821 | A1 * | 8/2010 | Grinberg | B41F 19/062 156/247 |
| 2012/0118184 | A1 * | 5/2012 | Sonnenschein | B41F 16/00 101/217 |
| 2012/0152444 | A1 * | 6/2012 | Weber | B41F 19/001 156/219 |
| 2012/0193024 | A1 * | 8/2012 | DeBard | B41F 19/001 156/277 |

* cited by examiner

DEVICE FOR SUPPLYING FOIL TO A PRINTING PRESS AND METHOD FOR DETERMINING CHARACTERISTICS OF CONTROL OF SUCH A DEVICE

CROSS-REFERENCE TO RELATED APPLICATIONS

This application claims the benefit under 35 U.S.C. §119 (a)-(d) and (f) of EP 15020165.5, filed 18 Sep. 2015, the entire contents and substance of that is hereby incorporated by reference.

BACKGROUND OF THE INVENTION

1. Field of Invention

The invention relates to a device for supplying foil to a printing press, the foil being intended to be used in a printing process during which transfer portions of a layer of the foil are transferred to a substrate to be printed, the device comprising a foil input unit for inputting at least one foil web to the device, and a foil reuse unit for receiving a used length of foil web from the printing press and feeding the same length of foil web back to the printing press in a longitudinally shifted position so as to allow the printing press to take transfer portions from the length of foil web at positions of the length of foil web that have not been addressed during previous use of the length of foil web in the printing process.

Furthermore, the invention relates to a method for determining characteristics of control of a device for supplying foil to a printing press and a computer program product comprising a program code of a computer program for use in such a method.

2. Background and Related Art

In general, the invention is applicable in the field of applying a thin layer of a metal such as aluminum to a substrate such as paper or carton during a printing process, as in this field, there is a need for useful methods relating to supplying a foil comprising the thin metal layer and a carrier layer to a printing press. In this respect, techniques for transferring the metal layer from the carrier layer of the foil to the substrate have been developed that do not require any heating process for letting the desired transfer take place. The foil that is used in carrying out these techniques usually comprises a carrier layer made of polyethylene, wherein a layer of aluminum is deposited on this carrier layer. In the following, for sake of clarity, the term "transfer layer" will be used as a general term for the layer that is suitable for transfer to the substrate.

By using the foil as described in the foregoing, it is possible to realize printed matter having shiny, silver-like or gold-like portions, wherein the exact color of the portions is dependent on the color of the transfer layer of the foil that has been used during the printing process. In particular, the shiny portions are obtained by performing the following steps: applying a specific type of glue to predetermined areas on the substrate to be printed; and pressing the substrate and a length of the foil against each other, with the transfer layer of the foil facing the substrate. During the latter step, a transfer of the transfer layer from the carrier layer of the foil to the substrate to be printed takes place at the areas where the glue is present, so that the material of the transfer layer is arranged on the substrate according to the pattern of the glue.

The foil is often taken as a web from a coil that is unwound during a printing process in which the foil is used, so that the supply of foil can be continuous. In the printing press, the foil web is moved through a narrow gap between two cylinders of the printing press, wherein the substrate to be printed is arranged on one of the cylinders. At a position where the foil web is pressed against the substrate on the basis of pressing forces that are exerted on the foil due to interaction of the two cylinders of the printing press, predetermined portions of the transfer layer are transferred from the foil web to the substrate. After a length of foil web has passed the narrow gap between the cylinders of the printing press, and some portions of the transfer layer of the length of foil web have been used in the process of printing a substrate, the length of remaining foil is disposed of. For example, the foil web moves on to a device that is adapted to shred the foil.

A device as defined in the opening paragraph is known, for example, from EP 2 340 936 A1, which is hereby incorporated by reference. This patent publication relates to a method and a device for supplying foil to a printing press, which are suitable to be applied for reusing a length of foil web that has already been used in a printing process. In a practical embodiment of the device, a foil reuse unit is present, which is adapted to receive a used length of foil web from the printing press, to change a mutual position of the length of foil web and the printing press, and to feed the length of foil web back to the printing press. By changing the mutual position as mentioned, it is ensured that portions of a substrate to that transfer portions of a transfer layer of the foil need to be transferred are covered by unused portions of the length of foil web. The actions performed by the foil reuse unit can be repeated until there are no portions left on the length of foil web that can be used for covering portions of the substrate that need to be provided with the transfer portions. In general, reuse of a length of foil web, which may take place one time or more than one time, leads to reduction of waste of foil.

EP 2 340 936 A1 discloses an embodiment of the device in which it is not only possible to use a length of foil web more than one time, but also to divide a basic foil web in at least two smaller foil webs. In a practical case, one basic foil web may be divided in at least two smaller foil webs by performing a cutting process on the basic foil web. In this way, it is possible to create foil webs having a width that is smaller than a width of the substrate to be printed, wherein the width of the foil webs can be adjusted to the dimensions of the transfer portions of the transfer layer of the foil. In general, use of a number of smaller foil webs instead of a wider basic foil web leads to reduction of waste of foil.

It follows from the foregoing that EP 2 340 936 A1 discloses two different options of realizing optimal use of foil, namely by reusing lengths of foil web and by splitting a foil web. The two different options as mentioned may be combined, which is to say, a basic foil web can be divided in at least two smaller foil webs, and lengths of at least one of those smaller foil webs can be reused. It is an object of the invention to find a practical way of taking those two options into account and to further reduce waste of foil by enabling appropriate control of a device for supplying foil to a printing press.

BRIEF SUMMARY OF THE INVENTION

Briefly described, in a preferred form, a device for supplying foil to a printing press as defined in the opening paragraph is provided, further comprising a computing unit for determining characteristics of a process for controlling the device, the computing unit being adapted to read a pattern of transfer portions to be realized by means of the printing process, prior to operation of the device, and to evaluate various options as to input of the at least one foil web to the device and reuse of a length of foil web in the device so as to determine that option involves most efficient use of the foil for realizing the pattern, i.e. a highest degree of foil coverage.

Also, a method for determining characteristics of control of a device for supplying foil to a printing press is provided, the foil being intended to be used in a printing process during which transfer portions of a layer of the foil are transferred to a substrate to be printed, wherein a pattern of transfer portions to be realized by means of the printing process is provided in the form of a computer-readable file, and wherein a computer program is provided and run for reading the file, for evaluating various options as to input of at least one foil web to the device and reuse a length of foil web in the device so as to determine that option involves most efficient use of the foil for realizing the pattern, i.e. a highest degree of foil coverage, and for determining control signals to be transmitted to components of the device involved in foil input and foil reuse according to that optimal option.

It follows from the foregoing that the invention provides a way of determining how any given pattern of transfer portions can be distributed over the foil in a most efficient manner, taking into account practical possibilities, in particular possibilities in respect of 1) dividing a basic foil web into at least two smaller foil webs or inputting at least two separate smaller foil webs, and 2) reusing lengths of the foil web. A most efficient use of the foil for realizing a given pattern is a use that involves a highest degree of foil coverage and an associated minimum of foil portions that end up not being addressed in the printing process and that are eventually disposed of as waste. In particular, the computing unit of the device is used for performing the steps of reading a pattern of transfer portions to be realized by means of the printing process, prior to operation of the device, and evaluating various options as to input of the at least one foil web to the device and reuse of a length of foil web in the device so as to determine that option involves most efficient use of the foil for realizing the pattern, so that output is obtained that is suitable to be used for realizing actual control of the foil input unit and the foil reuse unit according to that optimal option during operation of the device. In a practical embodiment of the device according to the invention, the computing unit is adapted to run a computer program for the purposes of reading the pattern of transfer portions and determining the optimal option for controlling the device. Furthermore, in which respect, it is possible for the computing unit to be capable of applying output of a computer program in a process of automatically setting up the device for optimal foil usage. The computing unit may be part of a controller unit for setting up the device prior to operation and/or controlling the device, particularly the foil input unit and the foil reuse unit thereof, during operation. As an alternative, it is also possible that the output of the computer program is applied for manually setting up the device for optimal foil usage.

The computing unit is adapted to determine a degree of foil coverage for various possible combinations of foil web width, foil web number and foil web reuse number, and to perform a comparison of the degrees associated with the various possible combinations in order to determine that combination involves the highest degree. Foil web width and foil web number are examples of aspects of the input of the at least one foil web to the device, whereas foil web reuse number is an example of an aspect of reuse of a length of foil web in the device. For the sake of completeness, it is noted that other examples of aspects of input and reuse are feasible within the framework of the invention as well.

The computing unit may be adapted to take into account a limited number of standard values in respect of the foil web width. This option existing within the framework of the invention is related to the practical fact that foil webs normally come in standard sizes.

In order to have various possibilities when it comes to the input of foil to the device according to the invention, it is advantageous for the foil input unit to be capable of inputting more than one foil web to the device. In this respect, it is noted that the foil input unit may be equipped with a cutting arrangement for cutting a basic foil web in at least two smaller foil webs. In such a case, the foil input unit may furthermore have an arrangement for realizing parallel positioning of the smaller foil webs. An example of an arrangement that is suitable in this respect is an adjustable angle bar arrangement. As an alternative, the foil input unit may be suitable to accommodate a plurality of reels of foil and to address one or more of the reels during operation, depending on what is needed in a certain situation.

In a practical embodiment, the foil reuse unit is operable in one of two conditions, namely a first condition for reusing a single length of foil web up to a maximum of two times, and a second condition for simultaneously reusing two lengths of foil web one time. Particulars of the possibilities existing in respect of the reuse of the foil have a function in determining how many options need to be taken into account in a process of finding the option involving the most efficient use of the foil for realizing a given pattern of transfer portions.

It is practical for the foil reuse unit to comprise an arrangement of at least two elements for contacting and supporting a length of foil web in the foil reuse unit, the mutual position of the elements in the foil reuse unit being adjustable. Such an arrangement may be an adjustable angle bar arrangement, for example. Furthermore, the arrangement of at least two elements for contacting and supporting a length of foil web in the foil reuse unit may be incorporated in a movably arranged frame portion. Means for controlling positions of the angle bars in the adjustable angle bar arrangement and/or a level of the frame portion in the device on the basis of information regarding a positioning of unused portions of foil and positioning of portions of the substrate to be provided with transfer portions may be used in order to ensure that the foil is reused in such a manner that the portions of the substrate are covered by portions of the foil that have not been addressed earlier in the printing process.

The invention furthermore relates to a combination of a printing press and a device as described in the preceding paragraphs, wherein the device is arranged at a position for supplying at least one foil web to the printing press and for receiving at least one used length of foil web from the printing press. Preferably, this position is a position above printing cylinders that are part of the printing press, so that application of the device does not add to the amount of floor space that is needed for the printing press.

These and other objects, features and advantages of the present invention will become more apparent upon reading the following specification in conjunction with the accompanying drawing figures.

BRIEF DESCRIPTION OF THE DRAWINGS

Embodiments of the present invention will be now described by way of example only with reference to the accompanying drawings in which.

Figure 1:
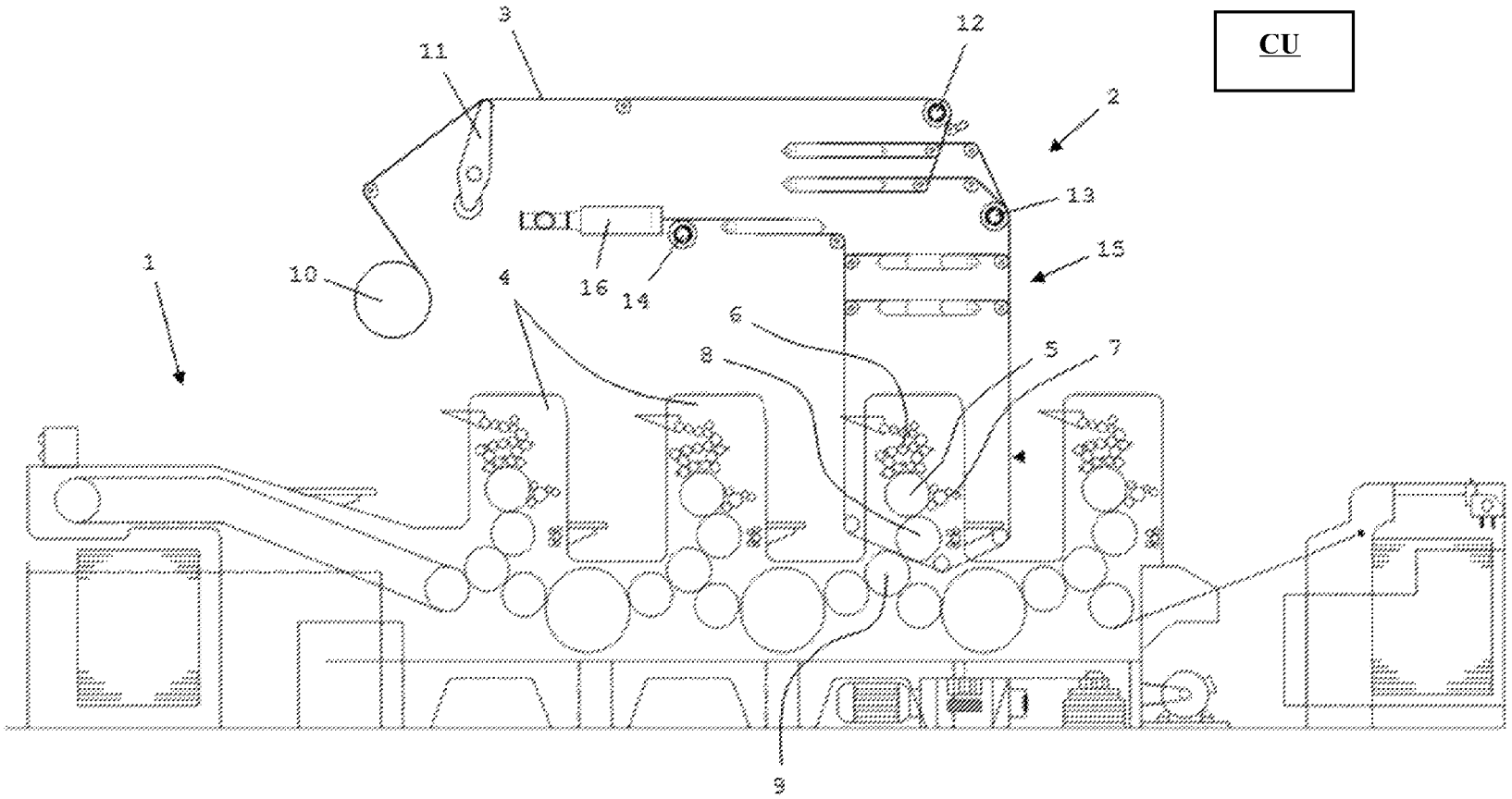
FIG. 1 diagrammatically shows a combination of a printing press and a foil supplying device according to the invention.

The figures are of a diagrammatical nature only and not drawn to scale. In respect of FIG. 1, it is noted that for the sake of illustration, the foil supplying device is shown on a larger scale than the printing press.

DETAILED DESCRIPTION OF THE PREFERRED EMBODIMENTS

To facilitate an understanding of the principles and features of the various embodiments of the invention, various illustrative embodiments are explained below. Although exemplary embodiments of the invention are explained in detail, it is to be understood that other embodiments are contemplated. Accordingly, it is not intended that the invention is limited in its scope to the details of construction and arrangement of components set forth in the following description or illustrated in the drawings. The invention is capable of other embodiments and of being practiced or carried out in various ways. Also, in describing the exemplary embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named.

Also, in describing the exemplary embodiments, terminology will be resorted to for the sake of clarity. It is intended that each term contemplates its broadest meaning as understood by those skilled in the art and includes all technical equivalents that operate in a similar manner to accomplish a similar purpose.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Similarly, as used herein, "substantially free" of something, or "substantially pure", and like characterizations, can include both being "at least substantially free" of something, or "at least substantially pure", and being "completely free" of something, or "completely pure".

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described as making up the various elements of the invention are intended to be illustrative and not restrictive. Many suitable materials that would perform the same or a similar function as the materials described herein are intended to be embraced within the scope of the invention. Such other materials not described herein can include, but are not limited to, for example, materials that are developed after the time of the development of the invention.

FIG. 1 diagrammatically shows a combination of a printing press 1 and a device 2 according to the present invention, which serves for supplying foil to be used in a printing process to the printing press 1. In the shown example, the foil is provided in the form of at least one foil web 3. In particular, the foil comprises two layers, namely a transfer layer such as a metal layer, and a carrier layer. It is intended to have a transfer of portions of the transfer layer from the carrier layer to a substrate (not shown in FIG. 1) such as a sheet of paper or a web of paper in the printing press 1, so that shiny portions are obtained on this substrate. The transfer may be realized in a way known per se, for example, by applying glue to the substrate to be printed and pressing the foil against the substrate, in such a way that the transfer layer of the foil contacts the substrate and is removed from the carrier layer at the areas where the glue is present.

With respect to the printing press 1, it is noted that this may be any type of printing press 1 that is capable of processing the foil and making shiny portions on printed matter by using the foil. In the example as shown in FIG. 1, the printing press 1 is a so-called offset press, and comprises a number of printing units 4 for adding various colors to the substrate to be printed. FIG. 1 shows a sectional view of the printing press 1, and a number of cylinders of this printing press 1 may be seen in this FIG. 1.

In each unit 4 of the printing press 1, a plate cylinder 5 is arranged, which is a carrier of a printing plate. During a printing process, oil-based printing ink is supplied to the printing plate, and to this end, ink rollers 6 are arranged in the unit 4 as well. Furthermore, dampening rollers 7 are arranged in the unit 4. Areas of the printing plate that are not having an image to be transferred to the substrate are kept in a humid state, as a result of that the ink cannot settle in these areas. According to the principles of offset printing technology, the image is not transferred directly from the printing plate to the substrate. Instead, an intermediate step is performed, in which a blanket is used for receiving the image from the printing plate and transferring the image to the substrate. In the printing unit 4, the blanket is mounted on a blanket cylinder 8 that is arranged at a position between the plate cylinder 5 and a cylinder 9 for supporting the substrate. This substrate supporting cylinder 9 could be an impression cylinder in case of a sheet fed press or a blanket cylinder in case of a web press.

As the offset printing process is known per se, this process will not be further explained here. In the context of the present invention, it is important to note that the foil web 3 is intended to be supplied to a printing area of the printing press 1, i.e. an area between the blanket cylinder 8 and the substrate supporting cylinder 9.

The foil web 3 is normally provided on a coil 10, and the foil supplying device 2 according to the present invention is adapted to realize a continuous supply of foil to the printing press 1. Furthermore, the foil supplying device 2 according to the present invention comprises means for tensioning and guiding the foil web 3. In the shown example, the means as mentioned comprise a dancer 11 and a roller arrangement for ensuring a correct tension in the foil web 3 and realizing an offset positioning of the foil web 3 as required. In FIG. 1, three main rollers of the roller arrangement are indicated by means of reference numerals 12, 13 and 14, respectively. Two of the main rollers 12, 13, 14 are input rollers 12, 13 that are arranged at a foil input side of the printing press 1, and one of the main rollers 12, 13, 14 is an output roller 14 that is arranged at a foil output side of the printing press 1.

The foil supplying device 2 is equipped with a unit 15 that is adapted to receive a used length of foil web 3 from the printing press 1, and to feed the length of foil web 3 back to the printing press 1, while changing a mutual position of the length of foil web 3 and the printing press 1. In view thereof, the unit 15 is referred to as foil reuse unit 15. It is noted that further details of the foil reuse unit 15 and an explanation of the way in which this unit 15 is operated will be given later, with reference to FIG. 2.

In order to achieve excellent printing results, it is important that the speed of the foil web 3 corresponds to the speed of the substrate in the printing press 1. In view of this, the foil supplying device 2 may be equipped with means (not shown) for detecting the speed of the substrate, which may involve detecting a rotational speed of the substrate supporting cylinder 9 of the printing press 1 in practice. Furthermore, a servo system (not shown) may be provided for controlling the rotational speed of various rollers of the foil supplying device 2 that serve for pulling the foil web 3.

Any suitable unit may be used for receiving and processing a portion of the foil web 3 that is no longer destined to be used. For example, a unit 16 that is suitable for performing a shredding action is provided. Furthermore, the unit 16 may be adapted to press the shreds in blocks that are suitable to be used for recycling purposes. In this way, automatic processing of the waste of the foil is realized.

Figure 2:
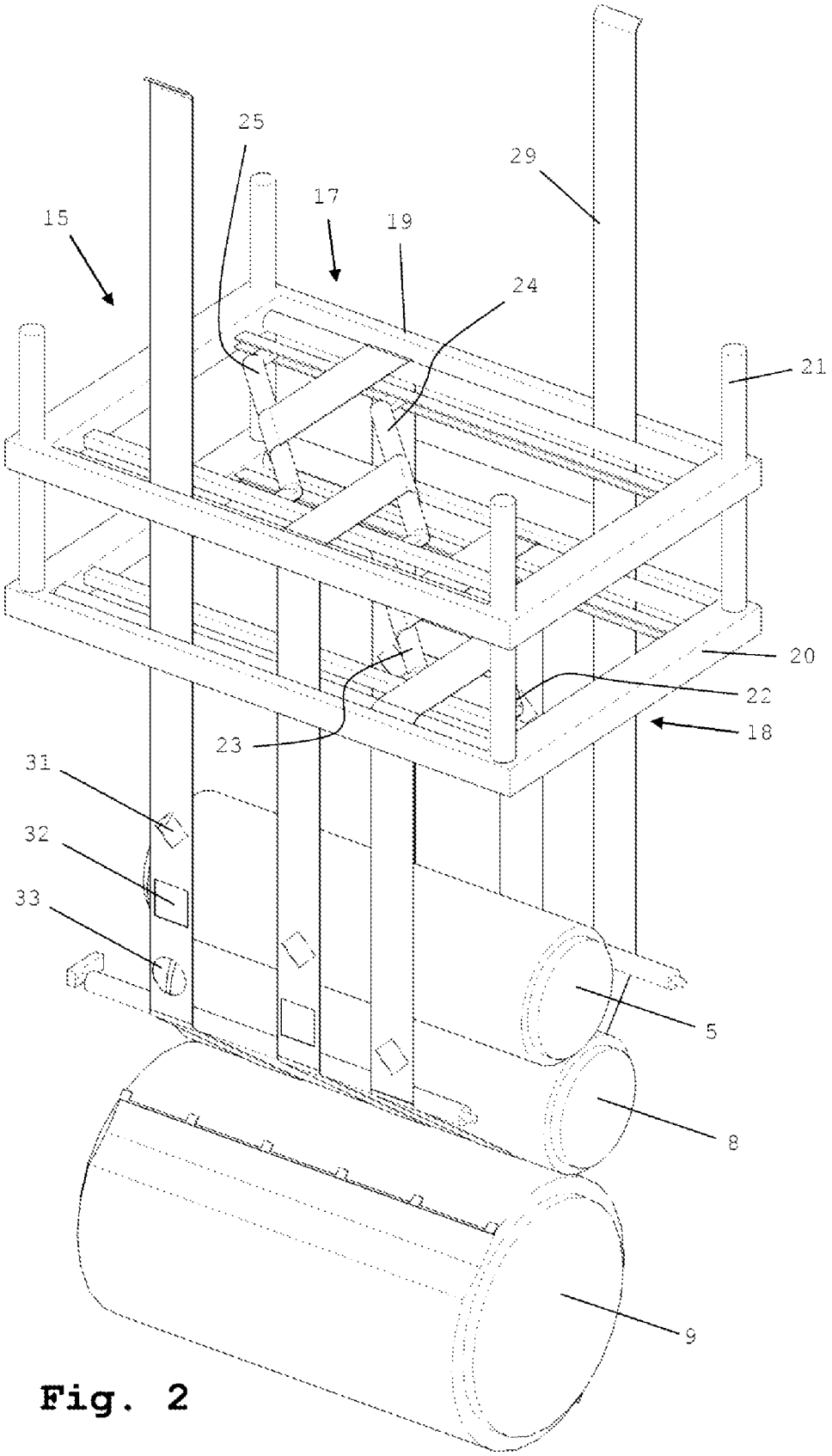
FIG. 2 diagrammatically shows a perspective view of components of the foil supplying device according to the invention, a number of printing cylinders of the printing press, and foil that is used and reused in a printing process.

A perspective view of components of the foil reuse unit 15 is shown in FIG. 2. Furthermore, FIG. 2 shows three cylinders of the printing press 1, namely the plate cylinder 5, the blanket cylinder 8, and the substrate supporting cylinder 9, and foil that is directed from the printing press 1 to the foil reuse unit 15, and back. In the shown example, the foil reuse unit 15 is positioned above the printing press 1, and comprises two adjustable angle bar arrangements 17, 18, and two frame portions 19, 20, wherein each of the angle bar arrangements 17, 18 is arranged in another of the frame portions 19, 20, and wherein a level of each of the frame portions 19, 20 with respect to the printing press 1 is adjustable. In respect of the latter aspect, it is noted that a frame portion 19 that is located at a higher level may be displaceable along guiding rods 21 extending from a frame portion 20 that is located at a lower level, as is the case with the embodiment of the foil reuse unit 15 as illustrated in FIG. 2. For sake of completeness, it is noted that this is just one example of many possibilities of realizing a suitable positioning of components of the foil reuse unit 15.

In the following, an explanation will be given of the functioning of the foil reuse unit 15. In particular, a path followed by a relatively small length of foil web 29 when moving from the input rollers 12, 13 to the shredding unit 16 will be described.

First, the length of foil web 29 moves from the input rollers 12, 13 to the printing press 1, where the length of foil web 29 passes between the blanket cylinder 8 and the substrate supporting cylinder 9 for a first time. In the printing process that takes place, a first portion 31 of the transfer layer of the foil is transferred to a substrate to be printed, which portion 31 is depicted as a diamond in FIG. 2. The length of foil web 29 then moves towards the foil reuse unit 15, and enters this unit 15 when passing a first angle bar 22 of the angle bar arrangement 18 that is located in the lower frame portion 20.

The length of foil web 29 moves from the first angle bar 22 to a second angle bar 23 of the angle bar arrangement 18 as mentioned. In the process, due to the positioning of the second angle bar 23, the length of foil web 29 is displaced with respect to the printing press 1 in a direction perpendicular to a direction of movement of the length of foil web 29. Furthermore, a displacement of the length of foil web 29 with respect to the printing press 1 in a direction corresponding to the direction of movement of the length of foil web 29 is determined by the mutual distance of the angle bars 22, 23, and the level of the lower frame portion 20 with respect to the printing press 1. On the basis of the first displacement, it is realized that another portion of the substrate can be covered by the length of foil web 29, which has a smaller dimension in the direction perpendicular to the direction of movement of the length of foil web 29, i.e. a smaller width, than the substrate. On the basis of the second displacement, it is realized that another portion of the foil web 29 than the portion where the transfer layer is no longer present is put in contact with the substrate at positions where new transfers of material from the foil to the substrate need to take place.

From the second angle bar 23, the length of foil web 29 is fed to the printing press 1 again, and moves through the narrow gap between the blanket cylinder 8 and the substrate supporting cylinder 9. In the printing process that takes place, a new portion 32 of the transfer layer of the length of foil web 29 is used, which is depicted as a square in FIG. 2.

The length of foil web 29, which has been used in a printing process two times now, is guided back towards the foil reuse unit 15 once again. In particular, the length of foil web 29 moves towards the upper frame portion 19, passes a first angle bar 24 of the angle bar arrangement 17 that located in the upper frame portion 19, and moves towards a second angle bar 25 of the angle bar arrangement 17 as mentioned. After having passed the second angle bar 25, the length of foil web 29 moves back to the printing press 1. A change of the position of the length of foil web 29 with respect to the printing press 1 is realized in the same manner as has been described with respect to the lower frame portion 20 and the angle bar arrangement 18 located in which frame portion 20.

The length of foil web 29 passes between the cylinders 8, 9 of the printing press 1 again, wherein a third portion 33 of the transfer layer of the length of foil web 29 is used in a printing process, on a third portion of the substrate. The third portion 33 of the transfer layer of the length of foil web 29 is depicted as a circle in FIG. 2. When the length of foil web 29 has moved through the printing press 1 three times in total, the length of foil web 29 moves from the printing press 1 to the shredding unit 16.

It follows from the foregoing that applying the foil reuse unit 15 offers the important advantage of efficient use of the foil. In a situation without a foil reuse unit 15, only one portion of the transfer layer of a length of foil web 29 is used in a printing process, whereas in a situation with the foil reuse unit 15, multiple portions of the transfer layer of the same length of foil web 29 are used in a printing process. The number of times that a length of foil web 29 may be fed back to the printing press 1 is determined by various factors, including a desired design of a printed pattern on the substrate. In any case, the number of times is at least one, the number of times may be two as in the shown example, and the number may be even more.

Figure 3:
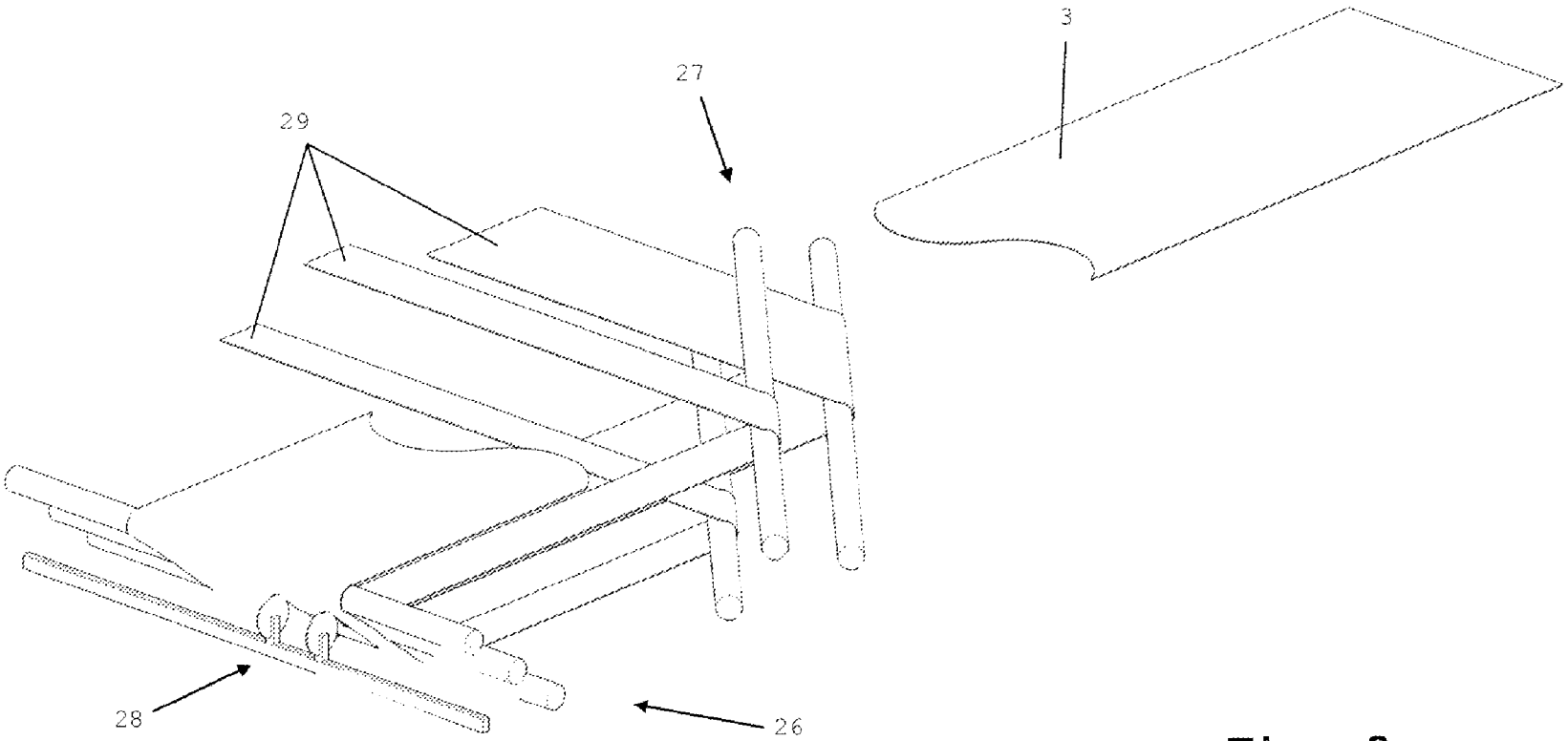
FIG. 3 diagrammatically shows a perspective view of a slitter unit and a number of bars, which may be part of the foil supplying device according to the invention, wherein, for the sake of clarity, a part of a length of foil web is cut away.

Throughout the printing process, the shredding unit 16 is kept in an activated state in order to process a portion of the foil web 29 that remains after having passed the foil reuse unit 15 and the printing press 1 for the last time. The fact that the foil may be supplied in the form of a web having a relatively small dimension in the direction perpendicular to the direction of movement thereof, i.e. having a relatively small width, as shown in FIG. 2, is another factor in realizing a most efficient use of the foil. Normally, the foil is supplied in webs having a larger width. However, it is possible to apply means like angle bar arrangements 26, 27 and a slitter unit 28 having a number of rotatably arranged slitters, as illustrated in FIG. 3. In this way, it is possible to make a number of smaller foil webs 29 out of one basic foil web 3 having the full width, and to supply the smaller foil webs 29 to the printing press 1, wherein the angle bar arrangements 26, 27 are used for accurately positioning the foil webs 29, so that it is possible to feed these foil webs 29 to their respective destinations in the printing press 1, wherein the foil webs 29 are positioned so as to cover different portions of a substrate to be printed, which are successive portions in the direction perpendicular to the direction of movement of the foil webs 29.

For example, three smaller foil webs 29 may be cut from one basic foil web 3. It is not required for the smaller foil webs 29 to have the same dimension in the direction perpendicular to the direction of movement of the foil webs 29, i.e. to be of the same width. By applying the angle bar arrangements 26, 27, it is possible to guarantee that the various smaller foil webs 29 cannot get entangled, and that these foil webs 29 are supplied to the printing press 1 at appropriate positions. Those arrangements 26, 27 may be adjustable so as to be capable of varying the positions of the foil webs 29, which allows for adaptation of those positions to a specific situation.

Within the framework of the invention, it is possible to use cutting techniques for realizing a supply of at least two foil webs 29 instead of only one basic foil web 3 having a relatively large with, as described in the foregoing. Another possibility involves having a unit (not shown) that is suitable to accommodate various reels of foil webs 29 having a relatively small width, in which case realizing an appropriate supply of smaller foil webs 29 is not about performing a cutting process on a basic foil web 3 but about making a choice as to that reels should be addressed.

The printing process is all about providing a substrate with a predetermined printed pattern, which is a pattern of portions that are transferred from the foil to the substrate at appropriate positions on the substrate. It is possible to provide a single foil web 3 of a sufficient width for covering the substrate and performing the printing process on the basis of such a foil web 3. However, in which case, a lot of foil is wasted. As explained in the foregoing, it is possible to save on foil by dividing a basic foil web 3 into smaller foil webs 29, and also by reusing a length of foil web 3, 29. In the situation of a given pattern of transfer portions, it is desired to find out that practical option offers the best results, i.e. that practical option involves a minimum of waste of foil through a maximum degree of foil coverage. In particular, it is desired to determine how the foil should be input to the foil supplying device 2 and if the foil should be reused and if so, how many times, in order to realize the maximum degree of foil coverage. To that end, the foil supplying device 2 is equipped with a computing unit CU such as a computer for running a computer program, the program being adapted to read a pattern of transfer portions and to determine the associated optimal option for controlling the device 2.

Figure 4:
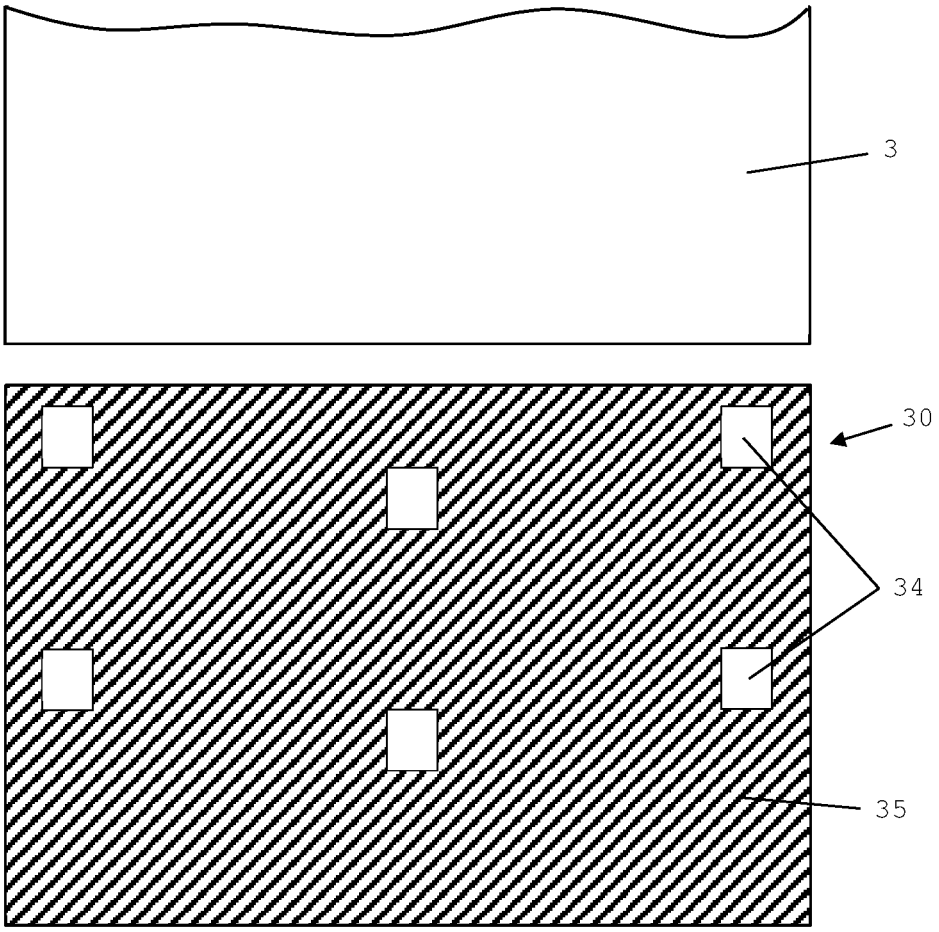
FIG. 4 illustrates how a pattern of transfer portions can be printed by applying a basic foil web.
Figure 5:
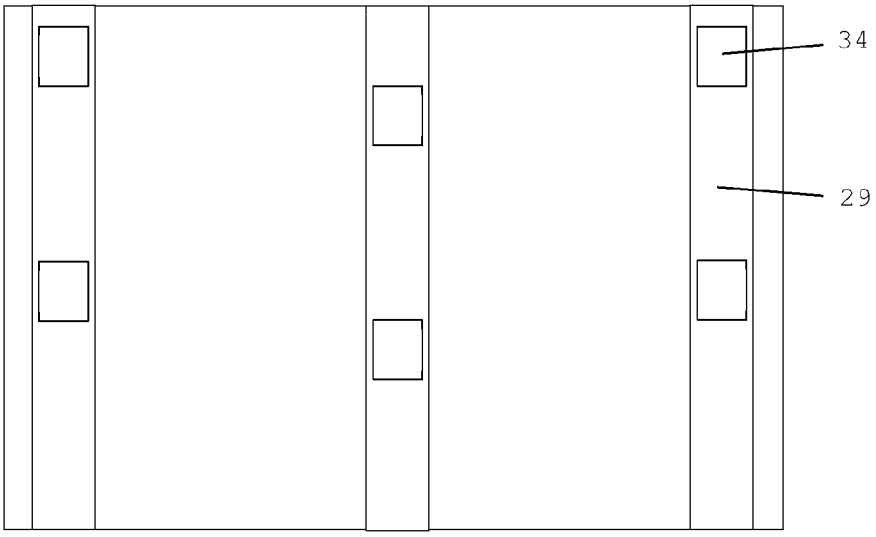
FIG. 5 illustrates how the same pattern of transfer portions can be printed by applying a number of parallel smaller foil webs.
Figure 6:
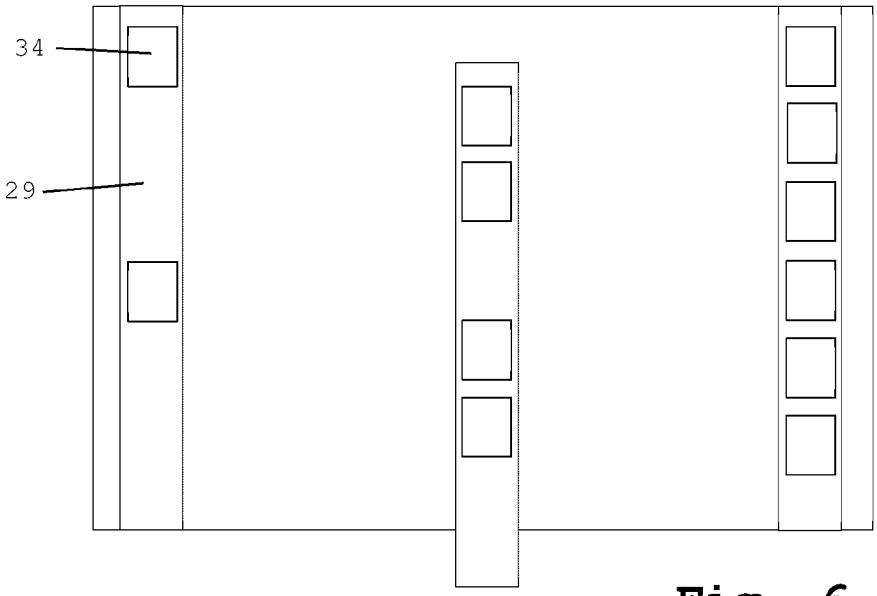
FIG. 6 illustrates how the same pattern of transfer portions can be printed by applying one smaller foil web and reusing that foil web two times.

For example, the computer program as mentioned may be adapted to read a PDF file containing an image of the pattern to be printed. Furthermore, the computer program may be adapted to calculate the degree of foil coverage for various options in respect of control of the foil supplying device 2, and to choose the control characteristics that are associated with the highest degree. With reference to FIGS. 4-6, the calculation process to be performed by the computer program will be further explained in the context of a relatively simple example of a pattern 30 of transfer portions 34.

In FIG. 4, the substrate to be printed is depicted in a hatched manner and indicated by means of reference numeral 35. In the shown example, the pattern 30 to be printed comprises two interspaced rows of three rectangles 34 distributed over the width of the substrate 35, wherein the middle rectangle 34 of the rows has a slightly different longitudinal position on the substrate 35 than the other two rectangles 34 of the rows. For the sake of completeness, it is noted that in this description, the direction of width is the horizontal direction in FIGS. 4-6, and that the longitudinal direction is the vertical direction in the figures. In the shown example, the width of the substrate 35 is assumed to be 1070 mm and the length of the substrate 35 is assumed to be 940 mm.

If the foil supplying device 2 would be controlled so as to supply a single foil web 3 for covering the entire width of the substrate 35, a part of that is diagrammatically shown in FIG. 4, at a position in the figure above the substrate 35, and to only use the foil web 3 one time in the printing process, a lot of foil would be wasted, namely all the foil surrounding the rectangles 34 of the pattern 30. In other words, in such a case, the degree of foil coverage is very low.

FIG. 5 illustrates a first option of saving foil, which involves splitting the foil web 3 in three smaller foil webs 29 having a width of 100 mm, for covering no more than the three longitudinal areas where the rectangles 34 of the pattern 30 are present, and using the smaller foil webs 29 only one time. In this first option, the degree of foil coverage is significantly improved, and up to 72% of foil can be saved with respect to the basic option of using a single foil web 3 only one time.

FIG. 6 illustrates a second option of saving foil, which involves applying a smaller foil web 29 having a width of 100 mm and using this smaller foil web 29 three times. On the left side of FIG. 6, it is diagrammatically depicted how a first set of two interspaced rectangles 34 is removed from the foil web 29 during first use, in the middle of FIG. 6, it is diagrammatically depicted how an additional second set of two interspaced rectangles 34 at a shifted longitudinal position on the foil web 29 is removed from the foil web 29 during second use, i.e. first reuse, and on the right side of FIG. 6, it is diagrammatically depicted how an additional third set of two interspaced rectangles 34 at a further shifted longitudinal position on the foil web 29 is removed from the foil web 29 during third use, i.e. second reuse. In this second option, the degree of foil coverage is even further improved, and up to 91% of foil can be saved with respect to the basic option of using a single foil web 3 only one time, assuming that inputting the small foil web 29 to the foil supplying device 2 does not involve waste of foil. Input waste is obtained in practice when the smaller foil web 29 needs to be cut from a basic foil web 3 that is of a standard width, preferably a standard width closest to the width of the smaller foil web 29 as desired. In a case of input waste, the degree of foil coverage is lower, as the degree of foil coverage is determined in respect of the basic foil web 3, unless it appears that all of the remainder of the basic foil web 3 can also be used one or more times in the printing process.

FIGS. 4-6 serve to illustrate the basics of the algorithm followed by the computer program during execution thereof. In general, the computer program is adapted to read a pattern 30 to be printed, and to determine that option as to input and reuse of the foil should be applied in order to have minimum waste of foil, i.e. maximum degree of foil coverage. The appropriate option is found by calculating a value that is directly related to the part of the foil that is wasted for various practical options of operation of the foil supplying device 2, and comparing the values associated with the different options in order to determine that option involves the lowest degree of waste. That practical options should be included in the calculation process is determined by practical limitations such as standards widths of foil and a maximum number of reuse to be realized by means of the foil reuse unit 15 of the foil supplying device 2, among other things. In any case, the output of the computer program is suitable to be used for setting up the foil supplying device 2, either completely automatic or manually, wherein in the first case, the computing unit is connected to the device 2 and is used to control the device 2, and wherein in the second case, it is advantageous for the device 2 to be equipped with an interface for communicating control characteristics to a user of the device 2.

It is preferred if the user of the combination of the printing press 1 and the foil supplying device 2 is allowed to choose that unit 4 of the printing press 1 is used for receiving and processing the foil. Therefore, it is preferred if the foil supplying device 2 is arranged in a displaceable support.

It is noted that in the foil supplying device 2, the at least one foil web 3, 29 is contacted by components of the foil supplying device 2 only at one side, namely the side of the carrier layer, wherein damage to the transfer layer is prevented. Among other things, this is achieved by using angle bar arrangements 17, 18, 26, 27.

Numerous characteristics and advantages have been set forth in the foregoing description, together with details of structure and function. While the invention has been disclosed in several forms, it will be apparent to those skilled in the art that many modifications, additions, and deletions, especially in matters of shape, size, and arrangement of parts, can be made therein without departing from the spirit and scope of the invention and its equivalents as set forth in the following claims. Therefore, other modifications or embodiments as may be suggested by the teachings herein are particularly reserved as they fall within the breadth and scope of the claims here appended.

What is claimed is:

1. A device for supplying foil to a printing press comprising:

a foil input unit for inputting a foil web to the device, the foil web formed of continuous longitudinal reuse lengths of foil web, the foil web comprising a transfer layer and a carrier layer, the transfer layer comprising transfer portions of foil transferred to a substrate to be printed in the printing press; and a foil reuse unit for receiving a used reuse length of foil web from the printing press, manipulating the foil web, and feeding the same reuse length of foil web back to the printing press;

wherein upon an initial pass of a reuse length of foil web to the printing press, an initial transfer portion of foil is transferred to the substrate to be printed thus leaving an initial area of carrier layer devoid of foil sized and shaped as the initial transfer portion of foil, leaving in the reuse length of foil web an amount of unused transfer portions of foil remaining on the carrier layer;

wherein upon a subsequent pass of the same reuse length of foil web to the printing press, a subsequent transfer portion of foil is transferred to the substrate to be printed thus leaving the initial area and a subsequent area of carrier layer devoid of foil sized and shaped as the initial and subsequent transfer portions of foil, leaving in the reuse length of foil web an amount of unused transfer portions of foil remaining on the carrier layer;

wherein after the initial pass of the reuse length of foil web to the printing press, the reuse length of foil web is received by the foil reuse unit and manipulated by the foil reuse unit so when the reuse length of foil web is fed to the printing press, the subsequent area does not fall upon the initial area;

wherein the foil reuse unit continues to manipulate the used reuse length of foil web through each pass until the remaining transfer portions of the reuse length of foil web will not accommodate a subsequent transfer portion, at which point the used reuse length of foil web exits the foil reuse unit.

2. The device of claim 1 further comprising a computing device, wherein the computing device determines how the foil reuse unit manipulates the foil web.

3. The device of claim 1, wherein the foil reuse unit comprises an arrangement of at least two elements for contacting and supporting a length of foil web in the foil reuse unit, the mutual position of the elements in the foil reuse unit being adjustable.

4. The device of claim 3, wherein the arrangement of at least two elements for contacting and supporting a length of foil web in the foil reuse unit is incorporated in a movably arranged frame portion.

5. A combination of a printing press and the device according to claim 1, wherein the device is arranged at a position for supplying at least one foil web to the printing press and for receiving at least one used length of foil web from the printing press.

6. The combination of claim 5, wherein the printing press comprises cylinders; and wherein the device is arranged at a position above the cylinders.

7. The device of claim 1, wherein the foil input unit comprises a cutting arrangement for cutting the foil web of an initial width into at least two thinner foil webs, each thinner foil web having a width less than the initial width;

wherein one of the thinner foil webs is sent to the foil reuse unit for receiving, manipulating, and feeding the same reuse length of the thinner foil web back to the printing press.

8. The device of claim 7, wherein the foil reuse unit manipulates the thinner foil web by longitudinally-shifting a subsequent area of carrier layer devoid of foil from prior subsequent areas.

9. The device of claim 1, wherein the foil reuse unit comprises a cutting arrangement for cutting the foil web of an initial width into at least two thinner foil webs, each thinner foil web having a width less than the initial width;

wherein each of the thinner foil webs is sent to the foil reuse unit for receiving, manipulating, and feeding the same reuse length of each of the thinner foil web back to the printing press.

10. The device of claim 9, wherein the foil input unit has an arrangement for realizing parallel positioning of the thinner foil webs.

11. The device of claim 1, wherein the foil reuse unit manipulates the foil web by longitudinally-shifting a subsequent area of carrier layer devoid of foil from prior subsequent areas.

12. A device for supplying foil to a printing press comprising:

a foil input unit for inputting a foil web to the device, the foil web formed of continuous longitudinal reuse lengths of foil web, the foil web comprising a transfer layer and a carrier layer, the transfer layer comprising transfer portions of foil transferred to a substrate to be printed in the printing press; and a foil reuse unit for receiving a used reuse length of foil web from the printing press, manipulating the foil web, and feeding the same reuse length of foil web back to the printing press, the foil reuse unit comprising:

a first adjustable angle bar arrangement arranged in a first frame portion, the first adjustable angle bar arrangement comprising a first angle bar and a second angle bar; and a second adjustable angle bar arrangement arranged in a second frame portion, the second adjustable angle bar arrangement comprising a first angle bar and a second angle bar;

wherein the level of each of the frame portions is adjustable in respect to the printing press;

wherein upon an initial pass of a reuse length of foil web to the printing press, an initial transfer portion of foil is transferred to the substrate to be printed thus leaving an initial area of carrier layer devoid of foil sized and shaped as the initial transfer portion of foil, leaving in the reuse length of foil web an amount of unused transfer portions of foil remaining on the carrier layer;

wherein the same reuse length of foil web moves towards the foil reuse unit, and enters the foil reuse unit when passing the first angle bar of the second adjustable angle bar arrangement located in the second frame portion;

wherein the same reuse length of foil web moves from the first angle bar of the second adjustable angle bar arrangement to the second angle bar of the second adjustable angle bar arrangement, where in the process, due to the positioning of the second angle bar the second adjustable angle bar arrangement, the same reuse length of foil web is displaced in a first displacement with respect to the printing press in a direction perpendicular to a direction of movement of the foil web;

wherein a second displacement of same reuse length of foil web with respect to the printing press in a direction corresponding to the direction of movement of the foil web is determined by the mutual distance of the first and second angle bars of the second adjustable angle bar arrangement, and the level of the lower frame portion with respect to the printing press;

wherein on the basis of the first displacement, another portion of the substrate can be covered by the length of foil web, which has a smaller dimension in the direction perpendicular to the direction of movement of the length of foil web;

wherein on the basis of the second displacement, another portion of the foil web other than the portion where the transfer layer is no longer present can be put in contact with the substrate at positions where new transfer portions of the foil to the substrate need to take place;

wherein from the second angle bar the second adjustable angle bar arrangement, the length of foil web is fed to the printing press again and a second transfer portion of foil is transferred to the substrate to be printed;

wherein the length of foil web, which has been used in a printing process two times, is guided back towards the foil reuse unit once again towards the upper frame portion, passes the first angle bar of first adjustable angle bar arrangement that located in the first frame portion, and moves towards the second angle bar of first adjustable angle bar arrangement;

wherein after having passed the second angle bar of first adjustable angle bar arrangement, the length of foil web moves back to the printing press, where a change of the position of the length of foil web with respect to the printing press is realized in the same manner with respect to the second frame portion and the second adjustable angle bar arrangement located in the second frame portion; and wherein from the second angle bar the first adjustable angle bar arrangement, the length of foil web is fed to the printing press again and a third transfer portion of foil is transferred to the substrate to be printed.

13. The device of claim 12, wherein the foil input unit comprises a cutting arrangement for cutting the foil web of an initial width into at least two thinner foil webs, each thinner foil web having a width less than the initial width;

wherein one of the thinner foil webs is sent to the foil reuse unit for receiving, manipulating, and feeding the same reuse length of the thinner foil web back to the printing press.

14. The device of claim 12, wherein the foil reuse unit comprises a cutting arrangement for cutting the foil web of an initial width into at least two thinner foil webs, each thinner foil web having a width less than the initial width;

wherein each of the thinner foil webs is sent to the foil reuse unit for receiving, manipulating, and feeding the same reuse length of each of the thinner foil web back to the printing press.

* * * * *